United States Patent [19]

MacFee

[11] 3,999,256

[45] Dec. 28, 1976

[54] FASTENING DEVICE

[75] Inventor: Norman W. MacFee, Conneaut Lake, Pa.

[73] Assignee: Textron, Inc., Providence, R.I.

[22] Filed: Apr. 13, 1976

[21] Appl. No.: 676,436

[52] U.S. Cl. ..... 24/207; 24/206 R

[51] Int. Cl.[2] ..... A44B 19/00

[58] Field of Search ..... 24/207

[56] References Cited

UNITED STATES PATENTS

| | | | |
|---|---|---|---|
| 2,983,019 | 5/1961 | Rae | 24/207 |
| 3,122,810 | 3/1964 | Lawrence | 24/207 |

*Primary Examiner*—Bernard A. Gelak
*Attorney, Agent, or Firm*—O'Brien & Marks

[57] ABSTRACT

A fastening device used in shoe and related closures has a V-shaped resilient wire attached to the opened closure flaps which may be drawn together by sliding a second wire member which is wrapped about it along the diverging portions. The two wire members are both hingedly received within a manipulating member and are retained in place by deforming parts of the manipulating member.

3 Claims, 5 Drawing Figures

FASTENING DEVICE

BACKGROUND OF THE INVENTION

1. Field of the Invention

In a fastening device of this type, a resilient wire member is bent to substantially V-shape so as to provide a pair of spaced apart arm-like portions integrally connected at one end by a transversely extending trunnion portion. This trunnion portion is hingedly attached to a journal member arranged at one end of a manipulating member. There is arranged a substantially U-shaped interconnecting member which is pivotally attached to the inner sides of the manipulating member. The U-shaped member encircles the arm-like portions of the wire member and slidably engages these arm-like portions whereby the arm-like portions are moved toward and away from one another upon movement of the manipulating member.

2. Description of the Prior Art

The invention relates to fastening devices particularly adaptable for shoes and the like of the type disclosed in U.S. Pat. No. 3,122,810.

SUMMARY OF THE INVENTION

In accordance with this invention, the fastening device includes a resilient wire member bent to substantially V-shape to define two arm portions which may be attached to the edges of an opening to be closed interconnected by a trunnion portion. The trunnion portion of the wire member is hingedly attached to the one end of a manipulating member by placing it between two spaced apart members extending outwardly in parallel from the manipulating member and deforming the spaced apart members such that they extend inwardly over the trunnion portion of the wire member.

The manipulating member has a channelized section within it which defines a pair of opposed spaced apart notches at one end and two parallel grooves at the other end. A pair of retaining flanges extend transversely from the manipulating member and are deformed such that they are bent inwardly over the spaced apart notches in the same manner as the spaced apart members.

A second wire member is substantially U-shaped having a loop portion which encircles the arm portions of the first wire member and has two outwardly extending fingers from its leg portions which selectively cooperate with the spaced apart notches. A pair of bevelled edge locking tabs cooperate with the leg portions of the second wire member to lock the second wire member parallel to the manipulating member within the grooves in the manipulating member.

Various other objects and advantages of this invention will be more apparent in the course of the following specifications and will be particularly pointed out in the appended claims.

DESCRIPTION OF THE PREFERRED EMBODIMENT

Figure 1:
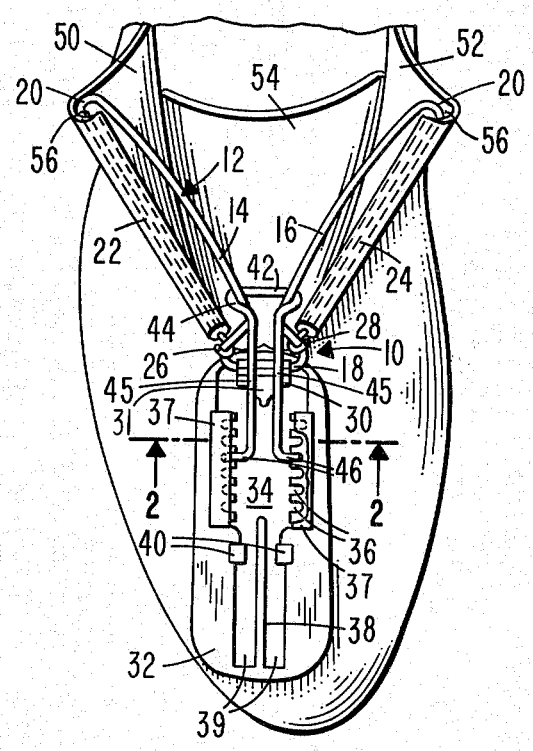
FIG. 1 is a fragmentary plan view of a shoe utilizing the improved fastener device of the present invention showing it in its fully open position with a portion of one of the overlapped retaining flanges cut away.

As shown in FIG. 1, the present invention is embodied in a fastening device 10 which may be used in fastening shoes or the like. The fastening device 10 consists of a relatively stiff resilient wire member 12 made of spring steel or some other suitable material which is bent to substantially V-shape, so as to provide a pair of spaced apart arm portions 14 and 16 integrally connected together at the lower end thereof by a transversely extending trunnion portion 18.

Each of the arm portions 14 and 16 are bent as at 20 to provide arm extensions 22 and 24 which are spaced apart from the arm portions 14 and 16. On the free end of these arm extensions 22 and 24, the wire member 12 is bent to form hooks 26 and 28, respectively, which detachably engage and cooperate with lower ends of the arm portions 14 and 16 adjacent the trunnion portion 18 at each side thereof. The arm portions 14 and 16 in cooperation with the arm extensions 22 and 24 and the hooks 26 and 28, form with two closed loops for attaching the assembly to a shoe.

Figure 3:
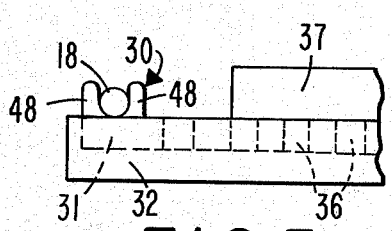
FIG. 3 is an enlarged side view of a portion of the manipulating member before the retaining flanges and the spaced apart member have been deformed.

The trunnion portion of the wire member 12 is pivotally received within a journal member 30 which is integrally attached to one end of an elongated plate-like manipulating member 32. As best seen in FIGS. 1 and 3, the journal member 30 includes a base 31 which has curved side portions and a pair of spaced apart members 48 extending outwardly in parallel from the base 31. The manipulating member 32 includes a channelized section 34 which extends the length of it as shown in FIG. 1. The channelized section 34 defines a series of opposed spaced apart notches 36 on both sides of the channelized section 34 at one end of the manipulating member 32. A pair of retaining flanges 37 extend from the manipulating member 32 adjacent the notches 36 and are bent such that they cover the notches 36. A narrow ridge 38 divides the channelized section 34 into two grooves 39 at the other end of the manipulating member 32. Two locking tabs 40 are provided on the outer edges of the grooves 39 near the center of the manipulating member 32 and extend inwardly. The inner edges of the locking tabs 40 are bevelled to form camming surfaces for a purpose hereinafter to be described.

A substantially U-shaped interconnecting wire 42 is provided which is formed preferably from a length of relatively stiff resilient wire so as to provide a loop portion 44 at one end thereof which is disposed around the arm portions 14 and 16 of the wire member 12 encircling the same which slidably engage these arm portions 14 and 16 to close the fastener in a manner to be described. Two leg portions 45 extend substantially in parallel from both sides of the loop portion 44, each having an outwardly extending finger 46 on its end, the fingers 46 cooperating with the notches 36 in the manipulating member 32 so as to permit selective adjustment therealong.

Figure 2:
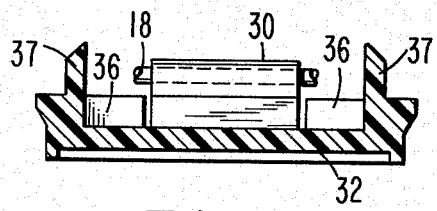
FIG. 2 is an enlarged sectional view taken along line 2—2 before the retaining flanges have been bent over the spaced-apart notches.

The fastening device is fabricated and assembled in the following manner. The manipulating member 32 is fabricated from a thermoplastic material through an injection molding process. As shown in FIGS. 2 and 3, the retaining flanges 37 are molded such that they extend transversely from the body of the manipulating member 32 adjacent the notches 36. Also the two spaced apart members 48 extend outwardly from the manipulating member 32.

Figure 4:
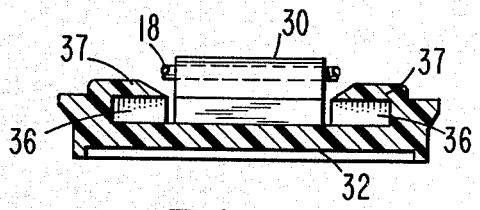
FIG. 4 is an enlarged sectional view taken along line 2—2 after the retaining flanges have been bent over the spaced apart notches.
Figure 5:
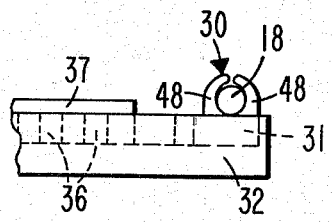
FIG. 5 is an enlarged side view of a portion of the manipulating member after the retaining flanges end the spaced apart members have been deformed.

In attaching the wire member 12 to the manipulating member 32, the trunnion portion 18 of the wire member 12 is placed within the concave recess defined between the pair of spaced apart members 48 of the journal member 30. As best seen in FIG. 5, the spaced apart members are then ultrasonically deformed such that they are folded toward each other over the trunnion portion 18 of the wire member 12. As best seen in FIGS. 4 and 5, the retaining flanges 37 are also deformed such that they no longer extend transversely from the manipulating member 32 but rather extend inwardly parallel to the manipulating member 32 across the top of the notches 36. The interconnecting wire member 42 is now attached by guiding the wire portions 14 and 16 of the wire member 12 within the loop portion 44 of the interconnecting wire 42 and inserting the fingers 46 into a pair of corresponding notches 36 in the manipulating member 32.

The fastening device is assembled in the shoe in the following member. FIG. 1 shows a shoe having the usual instep opening, side instep or a pair of flaps 50 and 52 to either side of the opening and an inner tongue 54. The edges of these flaps 50 and 52 are preferably folded upon themselves so as to provide longitudinally extending slots 56 which extend throughout the length of the flaps 50 and 52.

In attaching the fastening device 10 to the shoes the arm extensions 22 and 24 are inserted into the upper ends of the respective slots 56 in the flaps 50 and 52 and guided therethrough until the hooks 26 and 28 extend beyond the lower openings of the slots 56. The hooks 26 and 28 are then engaged with the lower ends of the arm portions 14 and 16 such that they are disposed around them adjacent the trunnion portion 18, thus securing the wire member 12 to the flaps 50 and 52. The fastening device 10 may be removed from the shoe by reversing the procedure.

The operation of the fastening device 10 will now be described. Assuming the fastening device 10 is in its fully open position as shown in FIG. 1, the manipulating member 32 is grasped and moved towards the tongue 54 of the shoe about its pivotal connection with the trunnion portions 18 of the wire member 12. In its movement, the loop portion 44 of the interconnecting wire 42 slides along the arm portions 14 and 16 thereby drawing them as well as the arm extensions 22 and 24 toward one another and also toward the tongue 54 of the shoe. In this way the flaps 50 and 52 which are attached to the arm extensions 22 and 24 are drawn over the shoe opening.

The manipulating member 32 is moved until the arm portions 14 and 16 of the wire member 12 are substantially parallel to the manipulating member. In this position, the leg portions 45 of the interconnecting wire member 42 are set within the grooves 39 of the manipulating member 32 and held there by the camming surfaces of the locking tab 40 so as to hold the two flaps 50 and 52 securely over the shoe opening. The interconnecting wire 42 is held by the locking tabs by a snapping action due to the resilient characteristics of the interconnecting wire 42. A firm, outward pull on the manipulating member 32 will allow the interconnecting wire 42 to snap past the locking tabs 40 and reopen the shoe.

As a result of our invention it will be seen that there is provided a simple and inexpensive fastening device which can be easily and conveniently fabricated and which is efficient and effective to use.

Inasmuch as the present invention is subject to many variations, modifications and changes in detail, it is intended that all matter contained in the above description and shown in the accompanying drawings shall be interpreted as illustrative and not in a limiting sense.

What is claimed

1. A fastening device comprising a resilient wire member bent to be substantially V-shaped so as to have a pair of spaced apart arm portions interconnected at one end by a transverse trunnion portion and having end hooks disposed adjacent said trunnion portion, said arm portions being attachable to the edges of the opening to be closed, a plate-like manipulating member, a journal member at one end of said manipulating member having a pair of spaced apart members having a concave recess defined between them, said spaced apart members extending outwardly in parallel, a channelized section in said manipulating member having a pair of opposed spaced apart notches at one end and two parallel grooves at the other end, a pair of retaining flanges adjacent said spaced apart notches extending transversely from said manipulating member, said spaced apart members being deformed inwardly towards each other and parallel to said manipulating member over said trunnion portion of said wire member whereby said wire member is hingedly held within said recess between said spaced apart members, said retaining flanges being deformed inwardly towards each other and parallel to said manipulating member such that said retaining flanges cover said spaced apart notches, a resilient substantially U-shaped interconnecting wire having a loop portion which encircles and slidably engages said arm portions and having a pair of substantially parallel elongated leg portions, a pair of outwardly extending fingers, one on each end of said leg portions, extending in opposite directions and which cooperate with said spaced apart notches in said manipulating member so as to permit selective adjustment of said interconnecting wire with said manipulating member, and a pair of locking tabs integrally attached to said manipulating member, each of said locking tabs within one of said grooves, respectively, said locking tabs having beveled inner surfaces with which said leg portions of said interconnecting wire cooperate in their opening and closing movement, said beveled inner surfaces preventing accidental movement of said interconnecting wire relative to said manipulating member by locking said leg portions of said interconnecting wire within said grooves when said leg portions are in a closed position.

2. The fastening device as recited in claim 1 wherein a narrow ridge divides the channelized section into the said two parallel grooves.

3. A fastening device as recited in claim 2 wherein the journal member includes a projecting base having curved sides whereby said wire hooks are precluded from separation away from said trunnion portion when said leg portions are in the closed position.

* * * * *